US010946241B2

(12) United States Patent
KashKash et al.

(10) Patent No.: US 10,946,241 B2
(45) Date of Patent: Mar. 16, 2021

(54) MAXIMUM PUSH-UP EXERCISE MACHINE

(71) Applicant: OK Engineering Inc., Palm Harbor, FL (US)

(72) Inventors: Omar Ismail KashKash, Palm Harbor, FL (US); Yousef Ismail KashKash, Dhahran (SA)

(73) Assignee: OK Engineering Inc., Palm Harbor, FL (US)

( * ) Notice: Subject to any disclaimer, the term of this patent is extended or adjusted under 35 U.S.C. 154(b) by 0 days.

(21) Appl. No.: 16/005,194

(22) Filed: Jun. 11, 2018

(65) Prior Publication Data

US 2019/0374814 A1 Dec. 12, 2019

(51) Int. Cl.

| | |
|---|---|
| ***A63B 23/12*** | (2006.01) |
| ***A63B 21/062*** | (2006.01) |
| ***A63B 21/00*** | (2006.01) |
| ***A63B 21/065*** | (2006.01) |
| ***A63B 26/00*** | (2006.01) |

(52) U.S. Cl.

CPC .... *A63B 23/1236* (2013.01); *A63B 21/00058* (2013.01); *A63B 21/065* (2013.01); *A63B 21/0628* (2015.10); *A63B 21/154* (2013.01); *A63B 21/4007* (2015.10); *A63B 21/4035* (2015.10); *A63B 26/003* (2013.01)

(58) Field of Classification Search

CPC ..... A63B 23/1236; A63B 21/0628; A63B 21/4007; A63B 21/00058; A63B 21/4035; A63B 21/154; A63B 26/003; A63B 21/065

See application file for complete search history.

(56) References Cited

U.S. PATENT DOCUMENTS 1,837,872 A * 12/1931 Johnson ..... A61F 5/04 602/34
4,111,414 A * 9/1978 Roberts ..... A63B 1/00 482/102
4,186,921 A * 2/1980 Fox ..... A63B 69/0088 24/115 H
4,431,184 A * 2/1984 Lew ..... A63B 7/00 482/102
4,606,539 A * 8/1986 Farnham ..... A63B 21/0023 482/148
5,033,741 A 7/1991 Ganzer
5,042,796 A * 8/1991 Jibril ..... A63B 21/00181 482/102

(Continued)

*Primary Examiner* — Garrett K Atkinson
(74) *Attorney, Agent, or Firm* — Nicholas Pfeifer; Smith & Hopen, P.A.

(57) ABSTRACT

One embodiment of a maximum push-up exercise machine (100) for various push-up exercises in the prone position on a platform (108) with weights having a cable-pulley weight stack system housing (102) with a cable-pulley weight stack system (104) that is welded, bolted, or connected in any manner to said platform. The configuration of the cable-pulley weight stack system may be in any manner such that a cable thimble (110) is positioned midpoint of the platform. The cable thimble is configured to receive snap link hook from a chain (150) suspended from a harness or belt (146) worn by a user (106), connect to a single cable handle attachment (148), and connect to a push-up bar (138) via a push-up bar cable connector (140).

15 Claims, 15 Drawing Sheets

(56) References Cited

U.S. PATENT DOCUMENTS 5,072,947 A * 12/1991 Blue ..... A63B 67/002 273/371
5,106,079 A 4/1992 Escobedo
5,165,682 A * 11/1992 McGuckin ..... A63B 43/04 473/424
5,352,176 A * 10/1994 Huang ..... A63B 21/0004 482/123
5,421,800 A * 6/1995 Mullen ..... A63B 21/00181 482/121
5,615,879 A * 4/1997 Bailey ..... A63B 69/0088 473/424
5,713,799 A * 2/1998 Balmat ..... A63B 43/008 40/327
6,220,994 B1 * 4/2001 Rich ..... A63B 21/0004 482/123
6,244,998 B1 6/2001 Hinds
6,419,586 B1 * 7/2002 Chiu ..... A63B 22/18 472/135
6,461,285 B1 * 10/2002 Theunissen ..... A63B 26/003 273/110
6,554,747 B1 * 4/2003 Rempe ..... A63B 21/04 482/38
6,719,676 B1 * 4/2004 Hsu ..... A63B 21/0004 446/220
6,945,919 B2 * 9/2005 Yang ..... A63B 5/11 482/141
7,566,291 B2 * 7/2009 Lickle ..... A63B 26/003 482/51
7,588,521 B1 * 9/2009 Fazzari ..... A63B 21/06 482/141
7,614,987 B2 * 11/2009 Guadagno ..... A63B 21/0004 273/449
7,645,221 B1 * 1/2010 Curry ..... A63B 23/12 482/148
7,857,740 B2 * 12/2010 Suaste ..... A63B 22/16 482/142
7,896,786 B1 3/2011 Osbourne
7,981,010 B1 * 7/2011 Webber ..... A63B 23/1209 482/96
8,057,367 B2 * 11/2011 Giannelli ..... A63B 21/0628 482/102
8,162,807 B1 * 4/2012 Webber ..... A63B 21/0615 482/100
8,277,327 B2 * 10/2012 Takeda ..... A63F 13/02 463/47
8,771,155 B1 * 7/2014 Bell ..... A63B 21/4017 482/124
8,882,645 B2 * 11/2014 Baptiste ..... A63B 21/0552 482/121
8,936,539 B2 * 1/2015 Richard ..... A63B 23/03541 482/123
8,944,971 B2 * 2/2015 Shorter ..... A63B 21/072 482/108
8,992,399 B2 * 3/2015 Wehrell ..... A61H 1/0229 482/124
9,132,330 B2 * 9/2015 Brendle ..... A63B 21/169
9,144,702 B2 * 9/2015 Calderone ..... A63B 23/1209
9,155,934 B2 10/2015 Kassel
9,180,338 B2 * 11/2015 Sorace ..... A63B 21/4005
9,205,299 B1 * 12/2015 Hall ..... A63B 21/0557
9,272,179 B2 * 3/2016 Lemos ..... A63B 23/12
9,295,872 B2 * 3/2016 Martens ..... A63B 21/4029
9,302,139 B2 * 4/2016 Habing ..... A63B 21/4035
9,327,157 B1 * 5/2016 Miller ..... A63B 21/4043
9,446,285 B1 * 9/2016 Drath ..... A63B 23/12
9,486,668 B2 * 11/2016 Williams ..... A63B 21/00065
9,511,258 B2 * 12/2016 Hoole ..... A63B 21/0615
9,616,274 B2 * 4/2017 Wehrell ..... A63B 21/4009
9,849,327 B2 * 12/2017 Nikkaran ..... A63B 23/03541
9,950,211 B2 * 4/2018 Williams ..... A63B 21/063
10,188,890 B2 * 1/2019 Olson ..... A63B 21/153
10,220,236 B2 * 3/2019 Oltorik, Jr. ..... A63B 21/4043
10,226,665 B2 * 3/2019 Kordecki ..... A63B 21/4031
10,286,279 B2 * 5/2019 Wehrell ..... A63B 21/154
10,426,989 B2 * 10/2019 Dalebout ..... A63B 22/02
2003/0158021 A1 * 8/2003 Prichard ..... A63B 69/0057 482/123
2004/0242388 A1 12/2004 Kusminsky
2005/0009677 A1 * 1/2005 Yang ..... A63B 21/0004 482/142
2006/0040808 A1 * 2/2006 Riazi ..... A63B 71/023 482/141
2006/0199706 A1 * 9/2006 Wehrell ..... A63B 21/4019 482/92
2007/0129226 A1 * 6/2007 Leavitt ..... A63B 23/0458 482/129
2010/0130338 A1 * 5/2010 Wehrell ..... A63B 21/154 482/124
2011/0275499 A1 * 11/2011 Eschenbach ..... A63B 21/00181 482/141
2013/0123081 A1 * 5/2013 Boland ..... A63B 21/023 482/141
2014/0274593 A1 9/2014 Kelly

* cited by examiner

MAXIMUM PUSH-UP EXERCISE MACHINE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILLING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The present invention relates to exercise devices for body weight exercises in the prone position with weights, and more particularly to exercise machines for various push-up exercises in the prone position with weights.

2. Background Art

The following is a tabulation of some prior art that presently appears relevant:

U.S. Patents

| U.S Pat. No. | Kind Code | Issue Date | Patentee |
|---|---|---|---|
| 7,588,521 | B1 | Sep. 15, 2009 | Carlo Fazzari |
| 9,511,258 | B2 | Dec. 6, 2016 | Richard J. Hoole |
| 6,244,998 | B1 | Jun. 12, 2001 | Jon Harrington Hinds |
| 9,205,299 | B1 | Dec. 8, 2015 | Raashed Hall |
| 5,033,741 | — | Jul. 23, 1991 | Gregory F. Ganzer |
| 9,155,934 | B2 | Oct. 13, 2015 | Blake Kassel |

U.S. PATENT APPLICATION PUBLICATIONS

U.S. patent application Publications

| Publication Nr. | Kind Code | Publ. Date | Applicant |
|---|---|---|---|
| 20040242388 | A1 | Dec. 2, 2004 | Richard Kusminsky |
| 20140274593 | A1 | Sep. 18, 2014 | Sean Kelly |

NONPATENT LITERATURE DOCUMENTS

SPLAZEM, Pushup Machine, www.instrucbles.com/home/health/, page 4

VICTOR TANG, Pushup Machine, Published on YouTube on Dec. 27, 2012, Weighed Pushup Machine PRO TRAINERS GYM, Push up Machine 7 8 2017, Published on YouTube on Jul. 10, 2017, The Extreme Pushup Machine Push-ups have always been used to measure one's body strength and is beneficial to people of all ages. Many people do bodyweight exercises such as push-ups along with weightlifting exercises in their workouts. People have the need to add resistance to push-ups in a safe and convenient manner to match the intensity of their weightlifting exercises within the timeframe of their workouts. People do push-ups with added resistance for two reasons: 1) keep doing push-ups with added intensity, and 2) improve bench press performance. Many people in commercial gyms use weights to increase the resistance of push-ups by placing weight plates on their back or wearing a weight vest. They use a partner to put the weight plate on their back and take it away when done from push-ups. In U.S. Pat. No. 7,588,521 to Carlo Fazzari (2009) one does push-ups with weights placed on weight support platform placed on one's back and as pushups are repeated the weight support platform with parallel upright rods slide up and down along parallel guide elements. In U.S. Pat. No. 9,511,258 to Richard J. Hoole (2016) a user performs weighted push-ups by grasping on a pair of hand grips that are above a lever arm and feet are placed on an elevated platform that is adjustable in height relative to the pair of hand grips. The lever arm having a proximate end coupled pivotally to a base and the lever arm is configured to provide a resistance against vertical movement of a distal end of the lever arm. The distal end of the lever arm is configured to receive a connector suspended from a belt or harness worn by a user. In U.S. Pat. No. 5,033,741 to Ganzer (1991) a wall mounted isometric push-up machine allows a user to perform push-ups against a padded base that provides resistance in the vertical direction using pressure springs. The user can adjust the amount of resistance by changing the pressure spring.

Few people in commercial gyms use chains to add resistance to push-ups by laying it over their back forming an X-shape. Another way people add resistance to push-ups is by using resistance bands. Some use clip bands/flat bands/strength bands to loop it over their backs and place their hands on the band and do push-ups. For example, in U.S. Pat. No. 6,244,998 to Jon Harrington Hinds (2001) push-ups with added resistance are done by placing a padded cushion on one's back and resistance bands are attached to it and to soft handles at the other end. In U.S. Pat. No. 9,205,299 to Raashed Hall (2015) a kind of resistance band known as flat band is looped around one's back and attached to hand grips to add resistance to push-ups. In U.S. Pat. No. 9,155,934 to Blake Kassel (2015) a user performs push-ups with added resistance using a resistance band known as clip band that loops around one's back and attached to hand grips. In U.S. patent application publication 20040242388 to Richard Kusminsky (2004) a user performs push-ups with added resistance by using a unidirectional exercise machine for increasing the effort required for a user to perform a push-up or other exercise including an adjustable brake engaging a cable drum for inhibiting the unwinding of a cable attached to a user during the extending portion of the exercise and a clutch operatively coupled to the brake for releasing the brake and allowing the cable to freely rewind during the retracting portion of the exercise. In U.S. patent application publication 20140274593 to Sean Kelly (2014) a user performs push-ups with added resistance by using a resistance push-up apparatus having a harness to be worn by a user and having hooks to attach the harness to a set of free weights. The push-up apparatus allowing the user to lift his or her own weight plus the extra free weights connected to the harness during the push-up exercise. In SPLAZEM the push-up machine is visually similar in construction to Carlo Fazzari's machine with the difference being in the placement of weight plates and the object the user pushes against. The weight plates are placed on the PVC pipes not on PVC pipe the user pushes against. In VICTOR TANG the pushup is similar in operation to Carlo Fazzari's machine with the difference being in the direction the weight support platform moves as the user pushes against it. In VICTOR TANG the weight support platform has an arc path as the user pushes against it. It's a first-class lever arm. Whereas in Carlo Fazzari's machine the weight support platform moves up and down as the user performs push-ups. In PRO TRAINERS GYM the operation is like VICTOR TANG's as it is a first-class lever arm. However, this one is more complex in operation as the user has to understand how to get into the push-up position to engage the weights of the machine and to reserve some energy before reaching muscular failure from performing push-ups to return to the starting position in order to unload the user from the machine's weights.

However, it is not safe to put a lot of weight plates on your back and do pushups even in the presence of a partner. In the case of wearing a weight vest, it is not safe to wear a heavy weight vest when doing pushups and reaching near failure. It is difficult to get out of a set of pushups when using a weight vest. The use of chains is not practiced at most commercial gyms and is inconvenient. For Fazzari's disclosure, it is difficult to get out of the prone (starting) position when done performing finger push-ups as the weight is still on the user or the weight support platform is right above the user. For Hoole's disclosure, one cannot perform push-ups such as finger push-ups and knuckle (punch/fist) push-ups with added resistance. For Hind's disclosure, one cannot perform finger push-ups and knuckle push-ups as well as push-ups with different hand grips with added resistance. It causes pain in the hands and wrists when using heavy resistance bands because the soft handles loop around the thumbs. For Hall's disclosure, one cannot perform finger push-ups and knuckle push-ups as well as push-ups with different hand spacing with added resistance. Also, one is limited by the amount of resistance they can use since only one flat band is used and other kinds of bands cannot be used. For Kassel's disclosure, one cannot perform finger push-ups, knuckle (punch/fist) push-ups, and push-ups with different hand spacing with added resistance. The resistance band may move or slide when one reaches the starting position of a push-up. For Kusminsky's disclosure, one cannot perform finger push-ups and knuckle push-ups as well as push-ups with different hand grips with added resistance. For Kelly's disclosure, it requires one to setup and create space for those who train in commercial gyms. Even if commercial gym members use two benches to execute push-ups with added resistance the benches are usually occupied by other gym members doing other exercises either by the dumbbell rack or in power racks/smith machines. Those interested in doing partial push-ups (the last few inches before the end position of a push-up) and isometric push-ups (static contraction) would have to setup and cannot easily do that in commercial gyms.

For SPLAZEM's disclosure, one may have to flare out their elbows and place their hands after the wood frame base when performing push-up exercises as shown in the disclosure because of PVC pipe locations and wood frame base. One would have to lift weight plates to add weight. And the staring position when doing pushup exercises is going to be more favorable for some people than others in terms of range of motion because of the way it is built. The PVC pipe the user pushes against is not distributed on the user's back due to its small surface contact area with the user's back. These reasons make it inconvenient, inefficient, and not a one-size fits all machine. For Victor Tang's disclosure, one would have to lift weight plates to add weight on the machine taking time and energy away from the push-up exercise thereby reducing exercise intensity. For Pro Trainers Gym's disclosure, one cannot perform push-up exercise to muscular failure because they must reserve some energy to place the machine to its starting position for user's safety.

These disclosures heretofore known suffer from a few disadvantages:

(a) One cannot perform various push-up exercises such as finger push-ups, knuckle (punch/fist) push-ups, push-ups with different hand grips, planks, and push-up to row (A.K.A push-up renegade row) with added resistance to failure independently in a safe and convenient manner along with other exercises in a workout without sacrificing valuable time for productive muscle building with time spent on setting up which most people do not have especially commercial gym members.

(b) One cannot perform various push-up exercises such as finger push-ups, knuckle push-ups, push-ups with different hand grips, planks, and push-up to row with added resistance all in one machine.

BRIEF SUMMARY OF THE INVENTION

In accordance with one embodiment a maximum push-up exercise machine comprises a cable-pulley weight stack system housing, a cable-pulley weight stack system, a platform, and a harness or belt with a chain having snap link hook suspended from the harness or belt worn by a user performing push-up exercises in the prone position with their hands on the platform.

Advantages

Accordingly, several advantages of one or more aspects are as follows: to provide a maximum push-up exercise machine with a cable-pulley weight stack system that enables a user wearing a harness or belt to perform push-ups (regular, finger, and knuckle) with weights and to quickly change the weights independently, that enables a user to perform planks and push-up to row exercises with weights, and that enables a user to perform push-ups on a balance and stabilization equipment with weights. These advantages will be apparent from a consideration of the drawings and ensuing descriptions.

BRIEF DESCRIPTION OF THE SEVERAL VIEWS OF THE DRAWINGS

In the drawings, closely related figures have the same number but different alphabetic suffixes.

DETAILED DESCRIPTION OF THE INVENTION—FIGS. 1A AND 1B

The word "exemplary" is used herein to mean "serving as an example, instance, or illustration." Any embodiment or design described herein as "exemplary" is not necessarily to be construed as preferred or advantageous over other embodiments or designs.

Figure 1A:
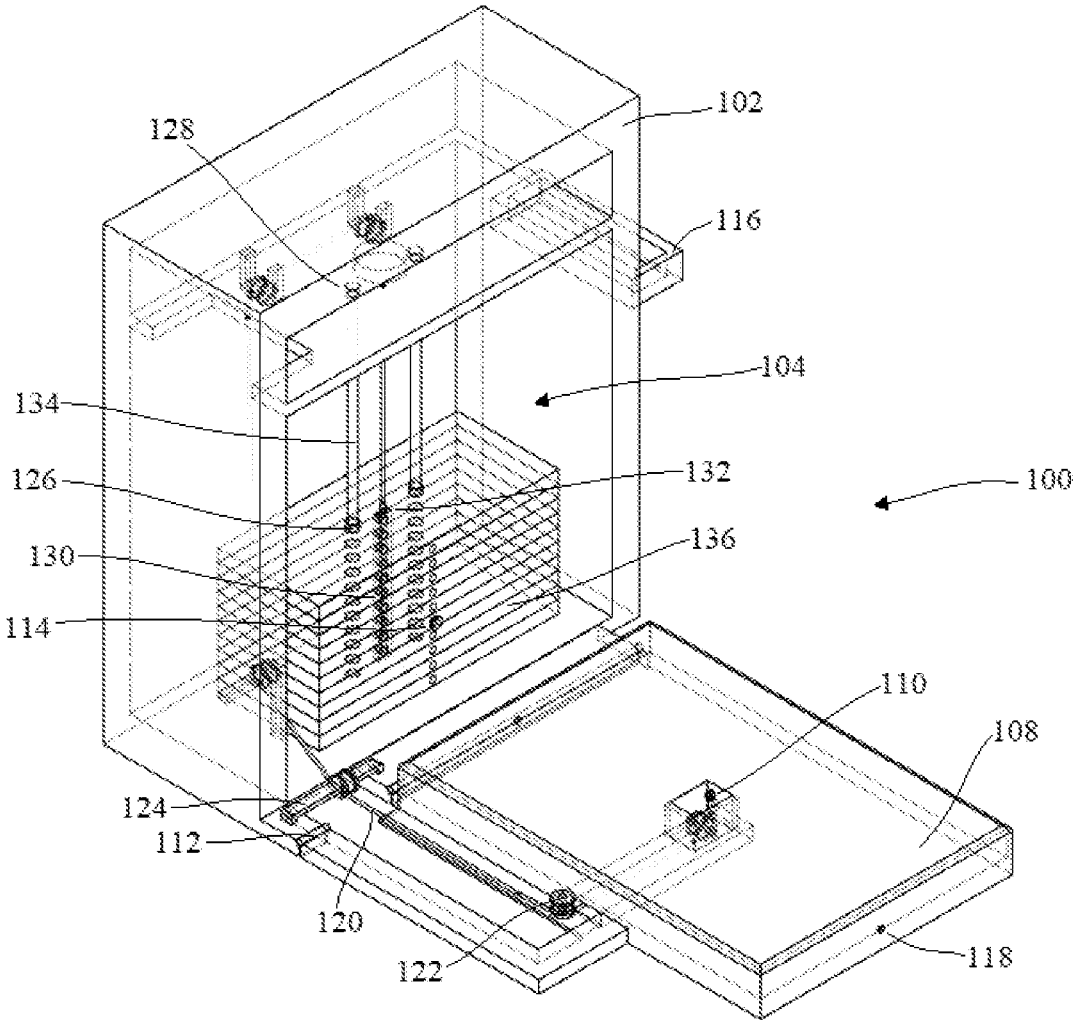
FIGS. 1A and 1B show a perspective view of a maximum push-up exercise machine in accordance with one embodiment.
Figure 1B:
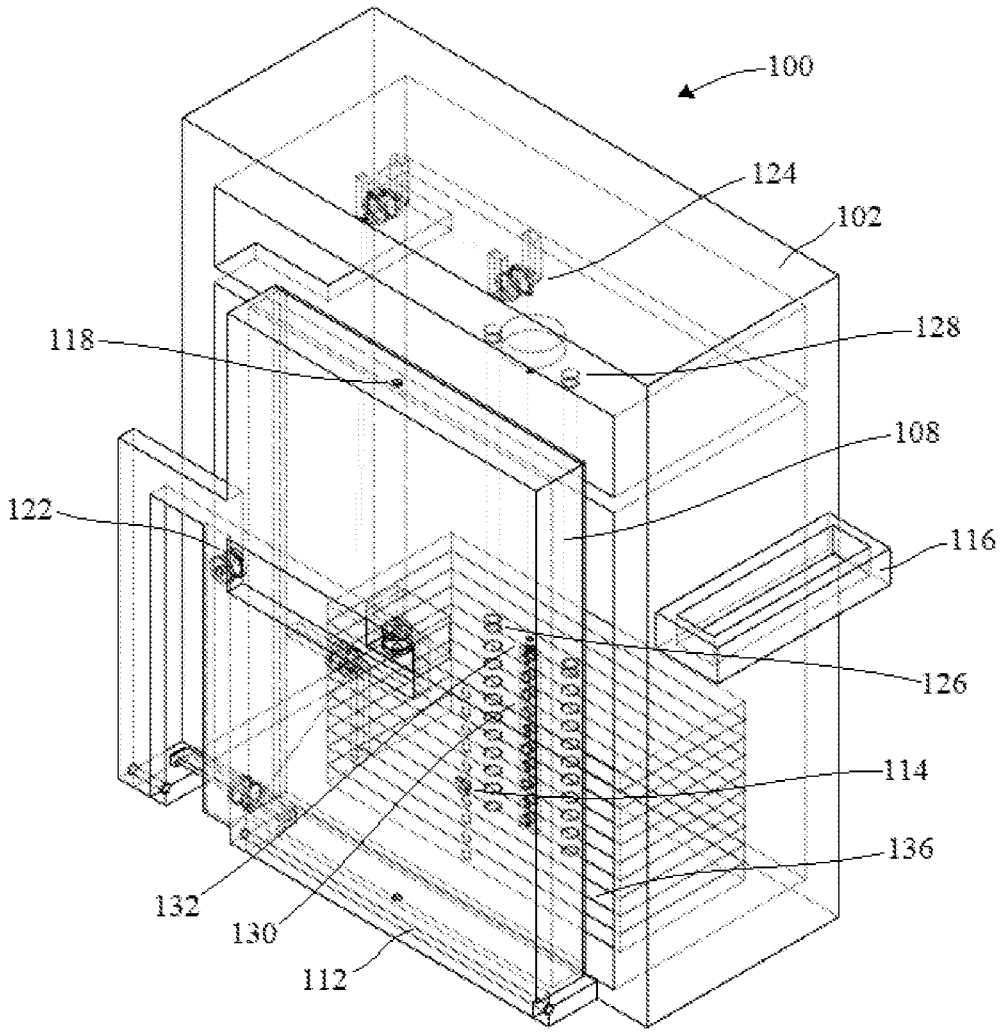

Referring now to FIG. 1A, an exemplary embodiment of a maximum push-up exercise machine 100 is disclosed. The maximum push-up exercise machine has a cable-pulley weight stack system housing 102, a cable-pulley weight stack system 104, and a platform 108. The maximum push-up exercise machine has a platform 108 bolted, welded, or connected in any manner to a cable-pulley weight stack system housing 102 with a cable-pulley weight stack system 104 configured to position a cable thimble 110 midpoint of the platform. The platform may be connected to the cable-pulley weight stack system housing via a hinge 112. Belts, cables, cams, pulleys, or any combination thereof may be used in the cable-pulley weight stack system. The configuration of the cable-pulley weight stack system may be in any arrangement such that the cable thimble is positioned midpoint of the platform. A weight stack selector pin 114 for selecting a desired weight is inserted into a weight stack 136. On one side of the cable-pulley weight stack housing is a container 116 to hold items such as towels, cleaning agent spray bottle, water bottle, etc. FIG. 1B shows the platform rotated about the hinge. This may aid in saving space in the storage and transportation of maximum push-up exercise machine from one place to another. The material of the cable-pulley weight stack system housing may be made of stainless steel or any other material known in the art. The material of the platform may be made of stainless steel covered with rubber like material such as rubber molded handle grips used in exercise handles, particle board/plywood covered with rubber horse stall mats like a weight lifting platform, any combination thereof, or any material known in the art.

OPERATION—FIGS. 2, 3, 4, 5, 6, 7, AND 8

Figure 2A:
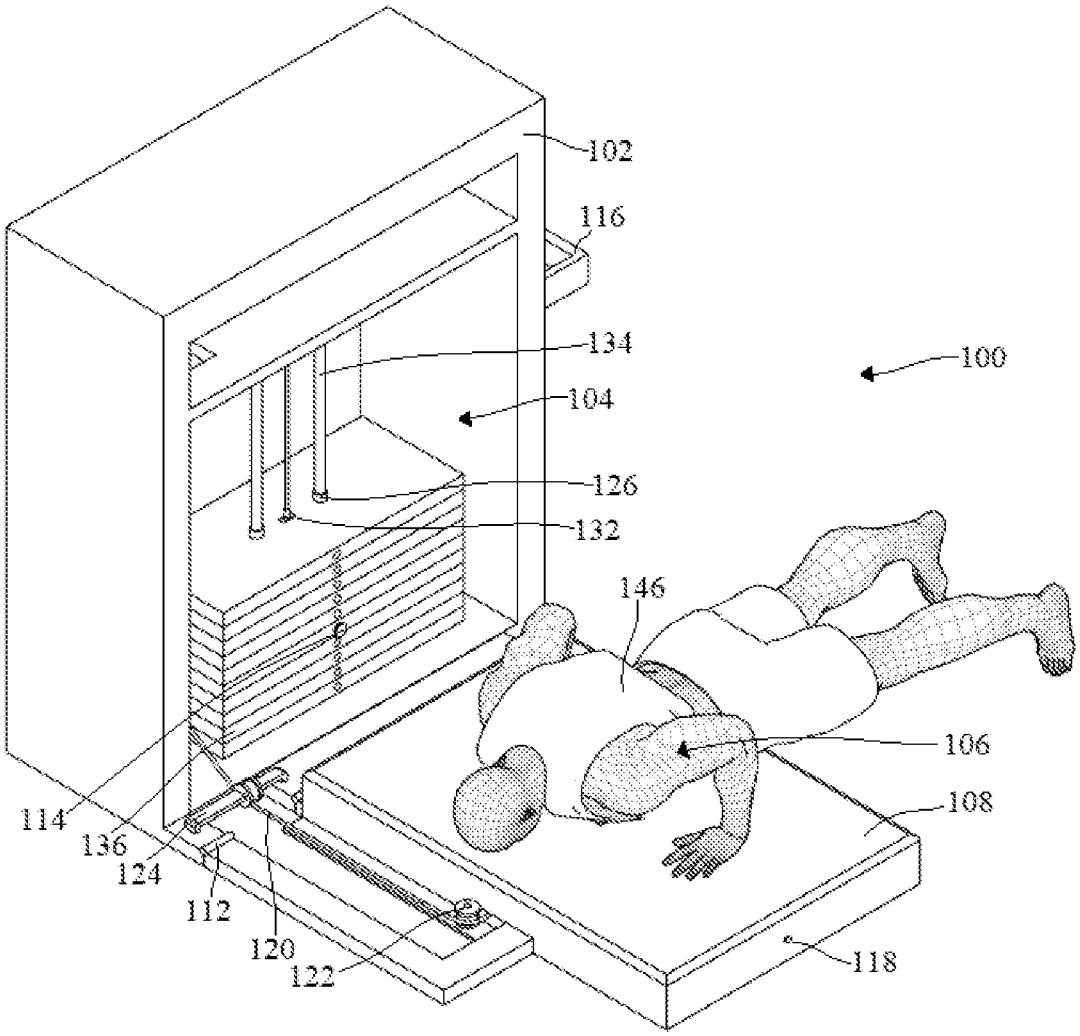
FIGS. 2A to 2C show a user performing a push-up exercise on maximum push-up exercise machine in accordance with one embodiment.
Figure 2B:
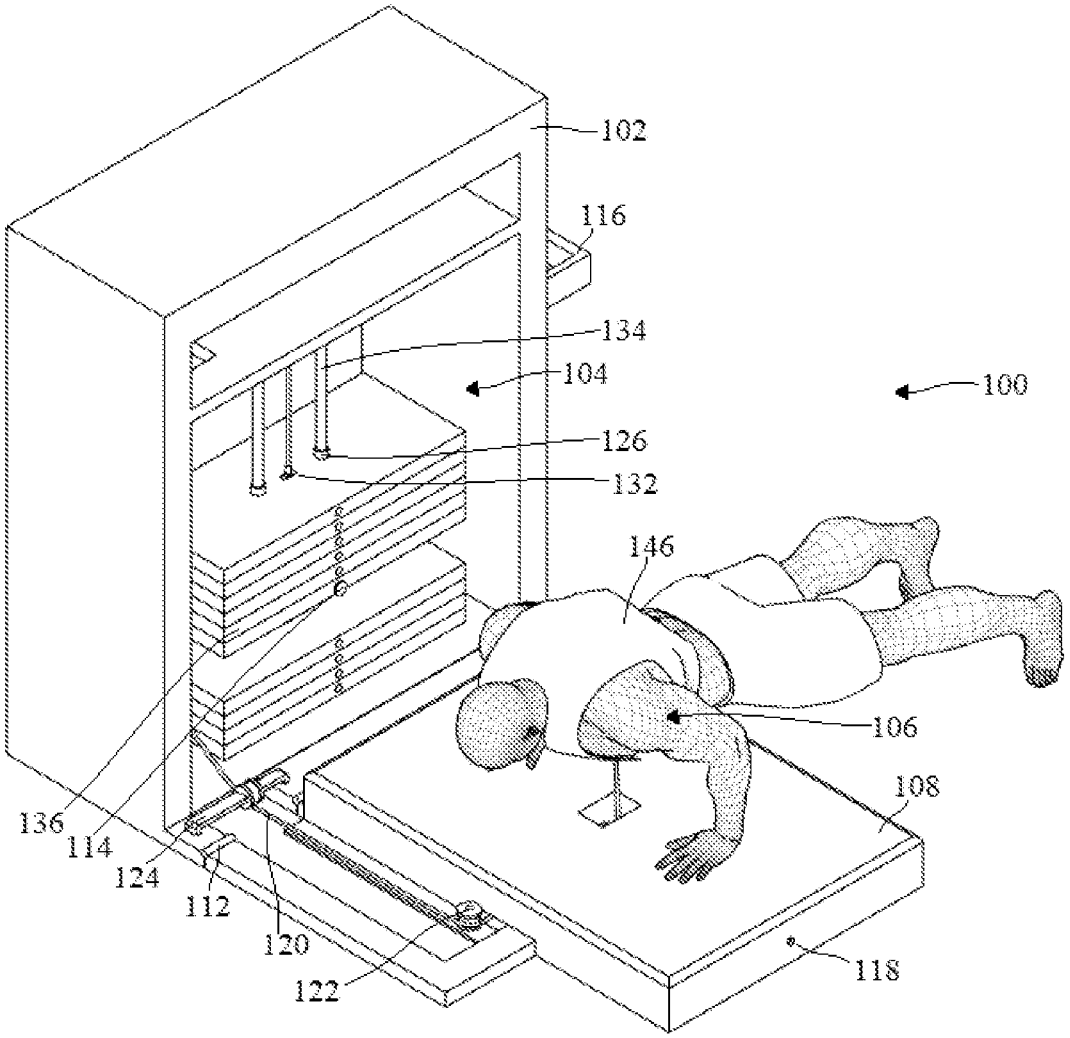
Figure 2C:
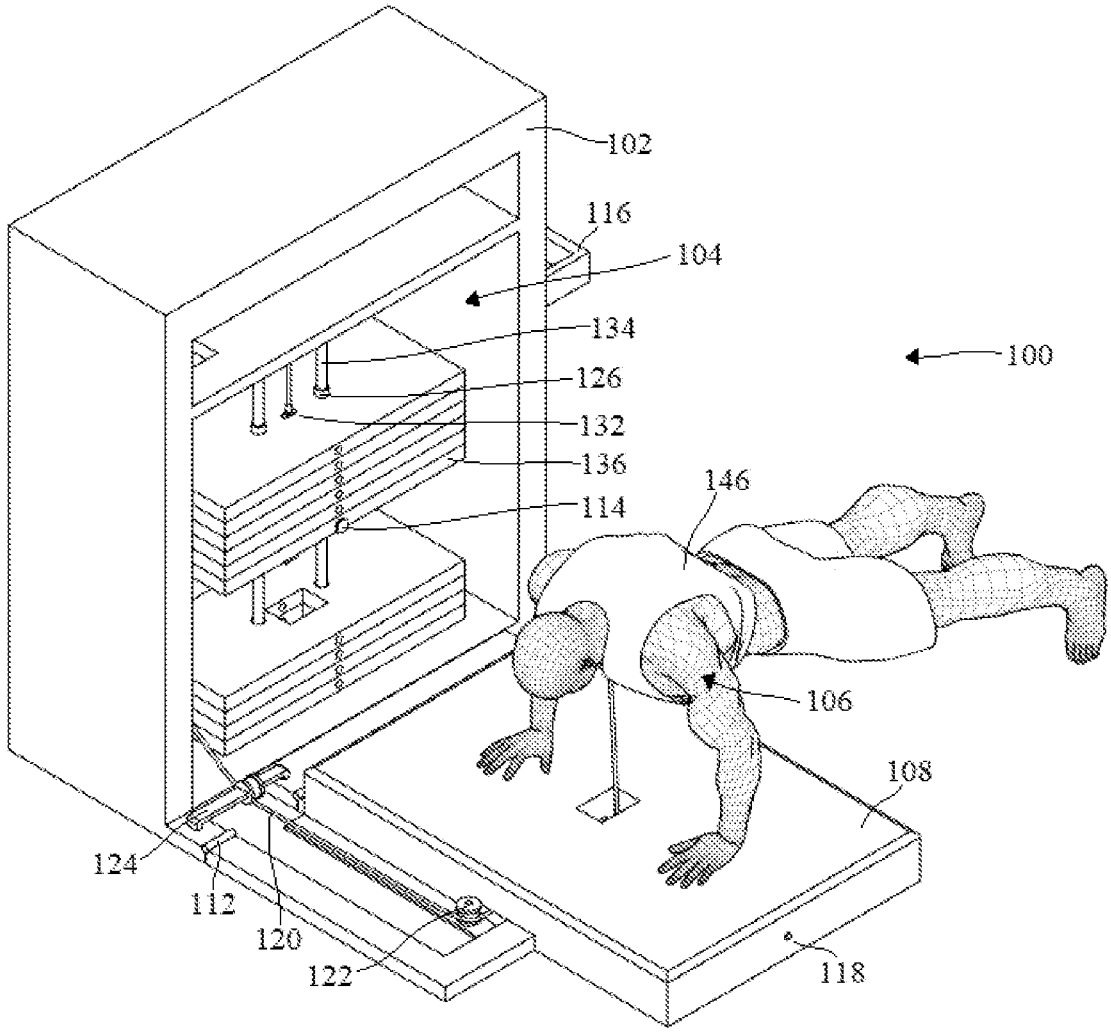

A user 106 performs various push-up exercises in the prone position with weights by first selecting a desired weight by inserting the weight stack selector pin 114 into the weight stack 136. Then, the user 106 wears a harness or belt 146 with a chain 150 having snap link hook suspended from the harness or belt 146 that the user can adjust the length of the chain to any link and connect the snap link hook to cable thimble 110. Then, the user 106 gets into the starting (prone) position of a push-up exercise with their hands on the platform 108 as shown in FIG. 2A. The user 106 can place their feet on a step-up exercise platform, swiss ball, medicine ball, or any other object to elevate their feet and change their body's angle. FIGS. 2A-2C show interaction between a user 106 wearing a harness or belt 146 and a cable-pulley weight stack system 104 while doing push-up exercise on the platform 108.

Figure 3:
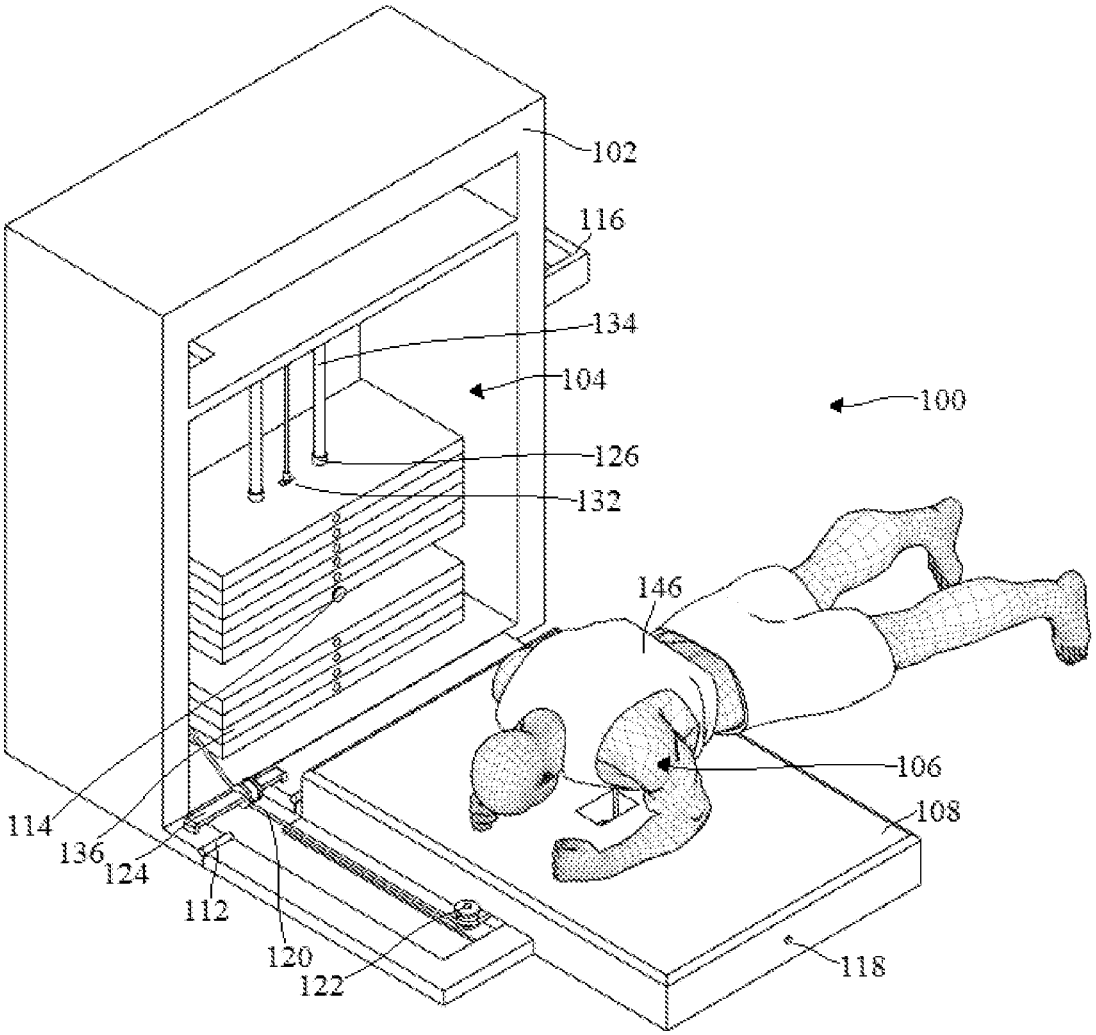
FIG. 3 shows a user performing planks on maximum push-up exercise machine in accordance with one embodiment.
Figure 4:
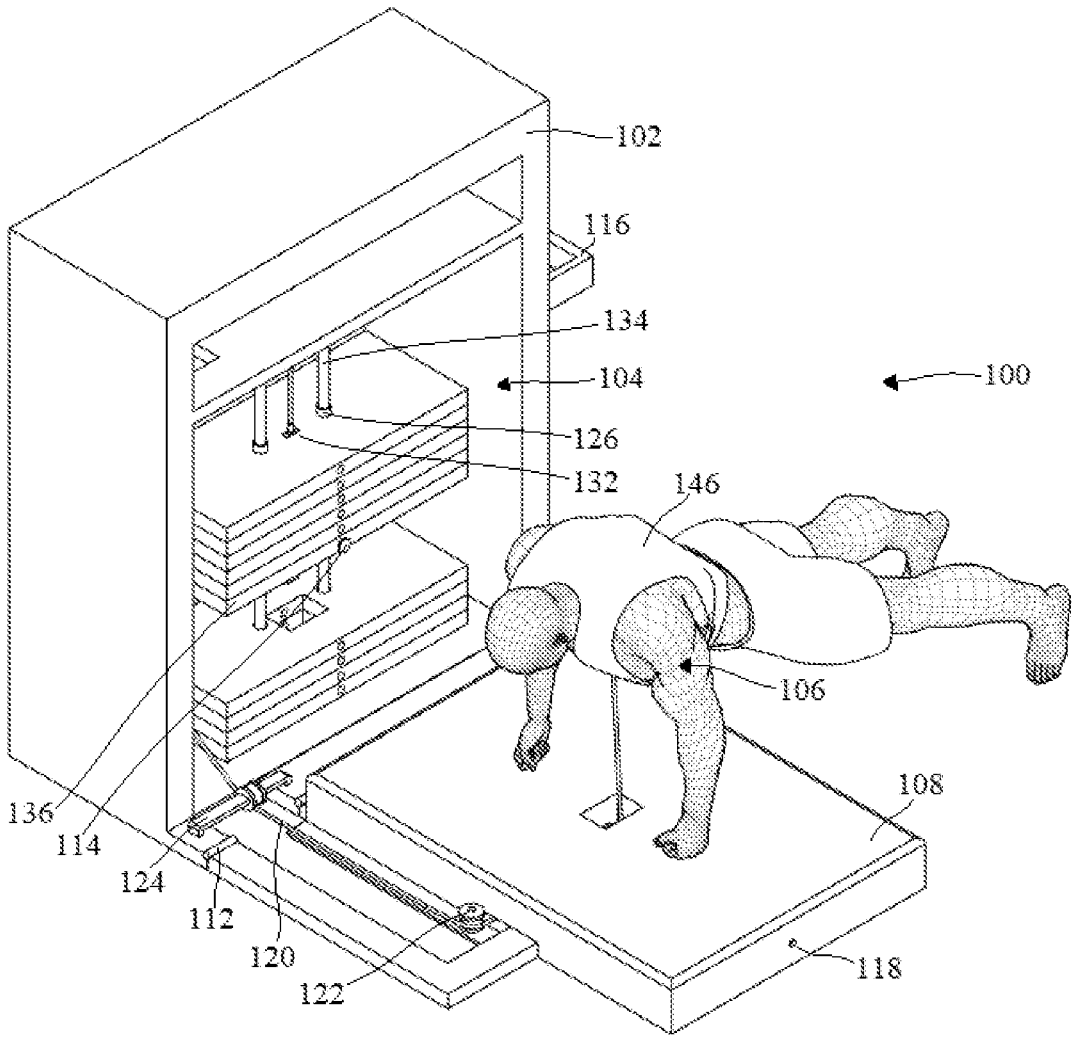
FIG. 4 shows a user performing a knuckle (punch/fist) push-up exercise position on maximum push-up exercise machine in accordance with one embodiment.
Figure 5:
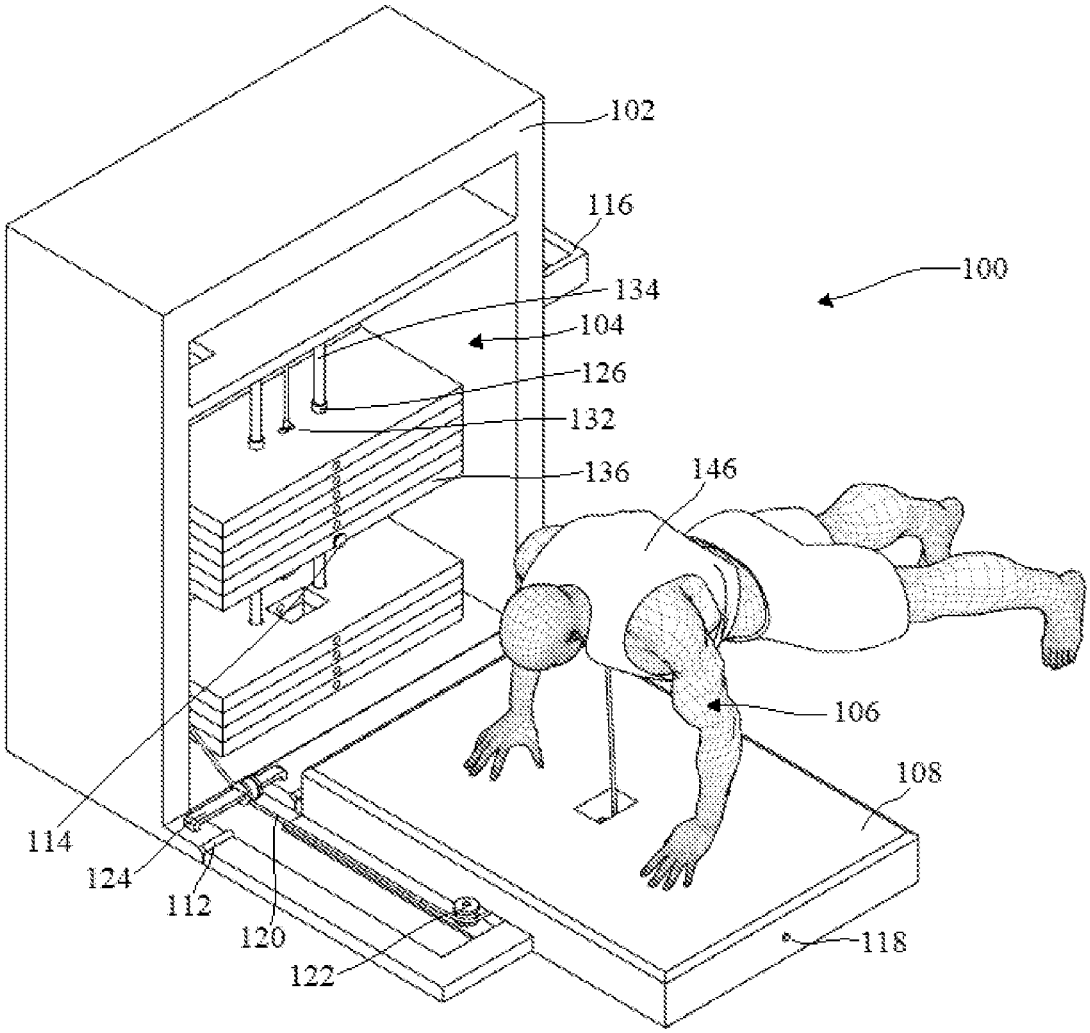
FIG. 5 shows a user performing a finger push-up exercise position on maximum push-up exercise machine in accordance with one embodiment.

FIGS. 3-5 show interaction between a user 106 wearing a harness or belt 146 and a cable-pulley weight stack system 104 while doing planks, knuckle (punch/fist), and finger push-up exercises on the platform 108.

Figure 6A:
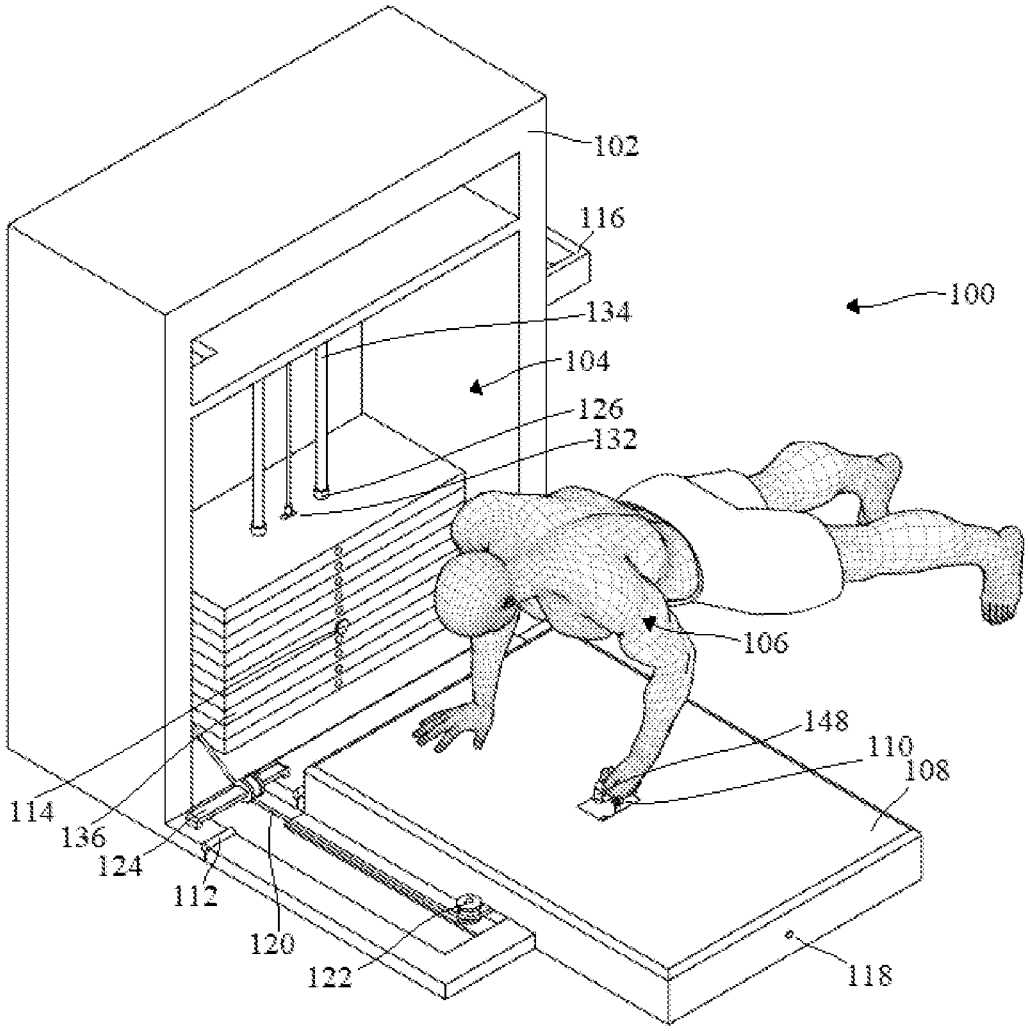
FIGS. 6A and 6B show a user performing push-up to row (push-up renegade row) exercise on maximum push-up exercise machine in accordance with one embodiment.
Figure 6B:
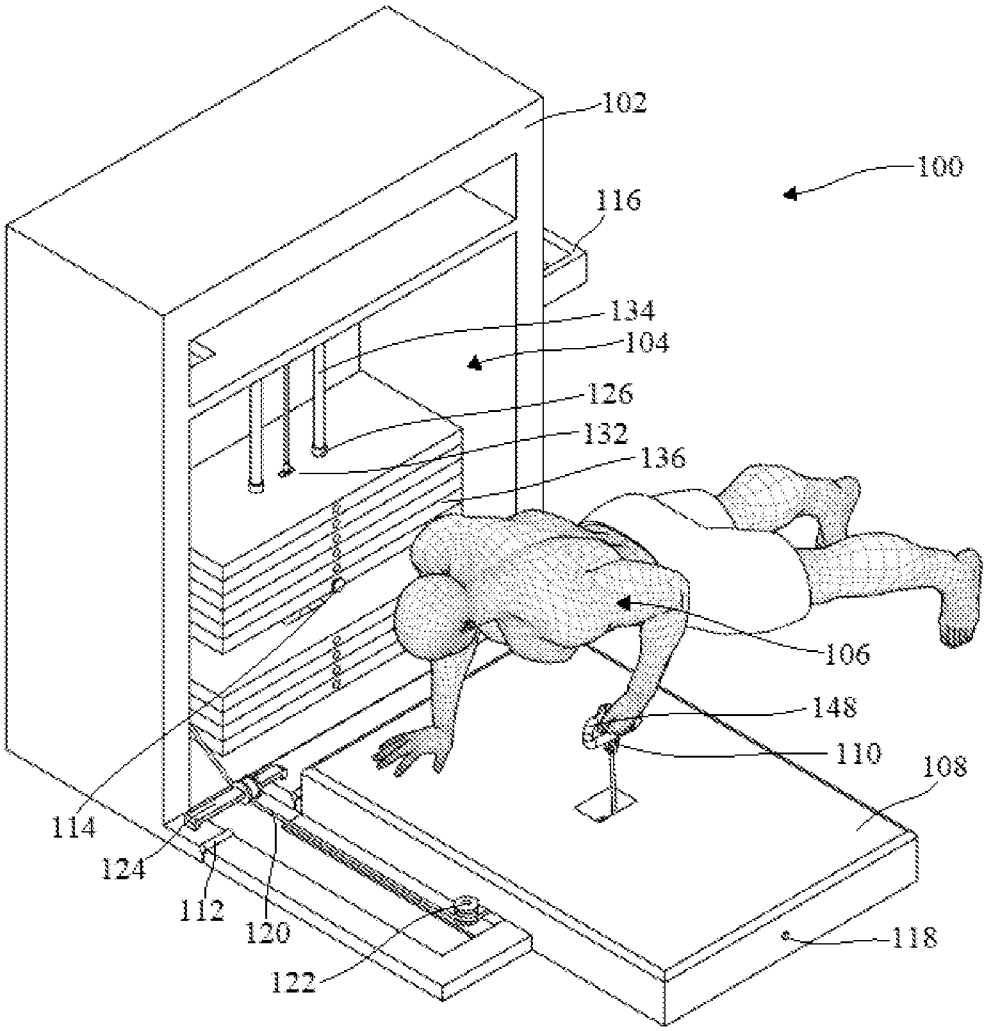

A user 106 can perform push-up to row (push-up renegade row) exercise with one hand on the platform 108 and other hand using a single cable handle attachment 148 that connects to the cable thimble 110 to overcome the weight selected from the weight stack 136 of the cable-pulley weight stack system 104 as shown in FIGS. 6A and 6B. In this scenario, the user assumes the end position of a push-up exercise with one arm on the platform and pulls (rows) with the other arm.

Figure 7A:
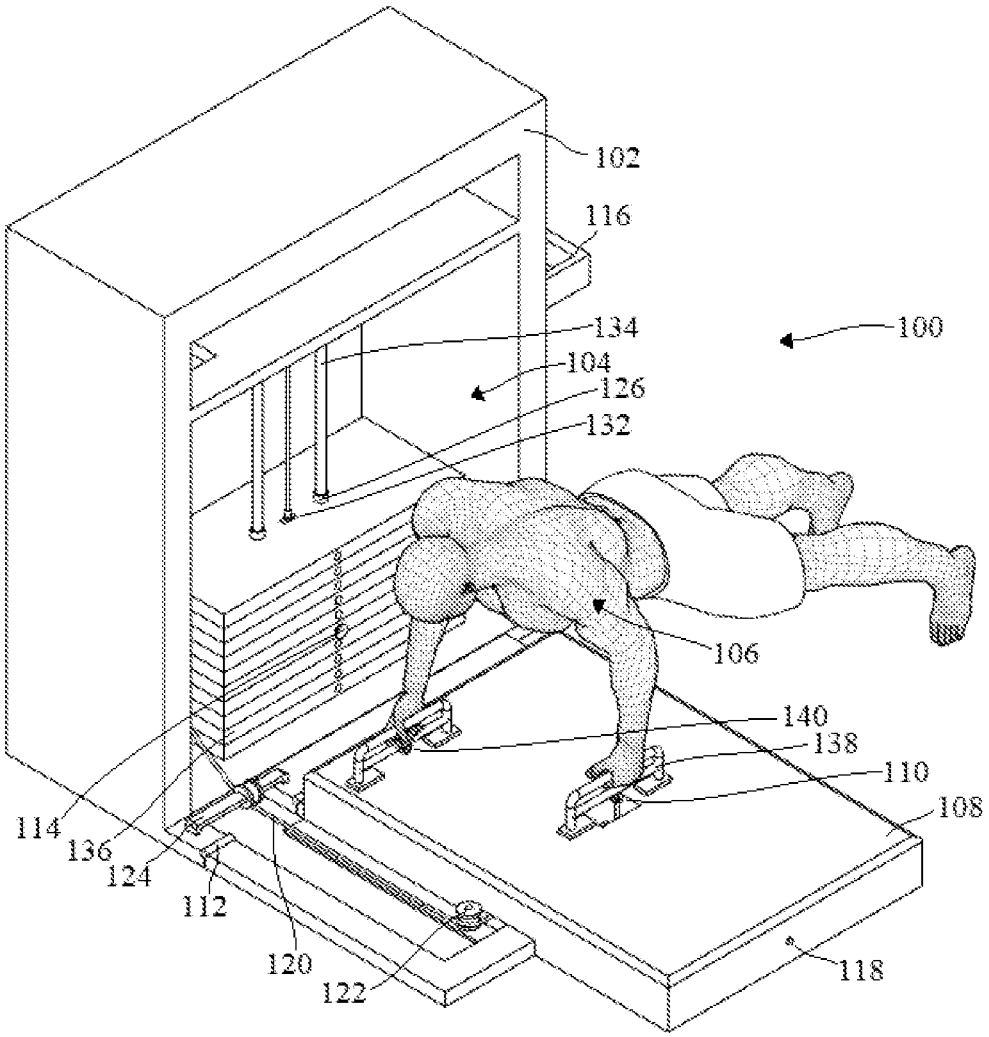
FIGS. 7A and 7B show a user performing push-up to row (push-up renegade row) exercise using push up bars a push-up bar on maximum push-up exercise machine in accordance with one embodiment.
Figure 7B:
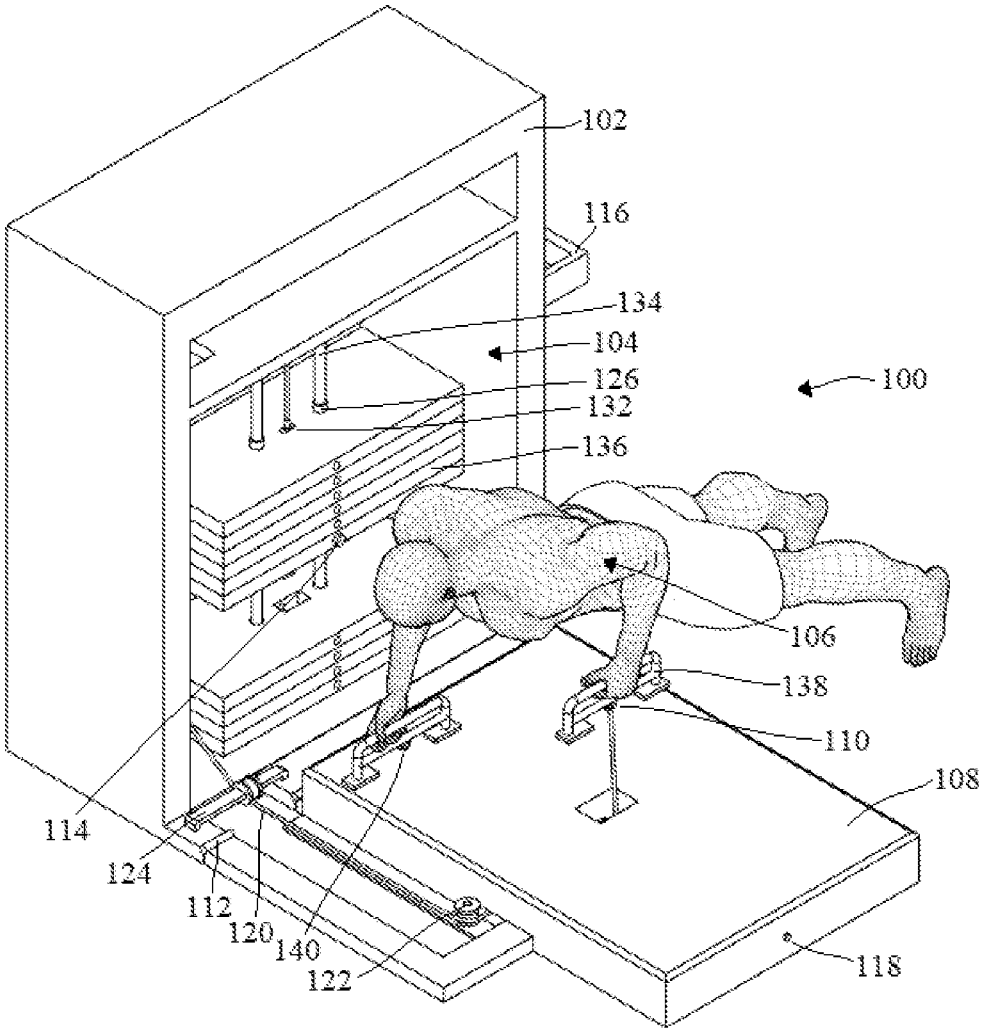

A user 106 can also perform push-up to row exercise using a push-up bar 138 with a push-up bar cable connector 140 as shown in FIGS. 7A and 7B. In this scenario, the user can perform a full range of motion push-up then pull (row) the weight with one arm. In addition, the user can also perform push-up to row plank hold by using push-up bars of different heights or a push-up bar 138 and a single cable handle attachment 148 with the pulling arm slightly lower than the other to feel the resistance of the weight and hold that position for as long as they can. This allows the user to engage the core muscles more to resist rotation of the torso because back muscles cannot be relied on as heavily to resist rotation.

Figure 8A:
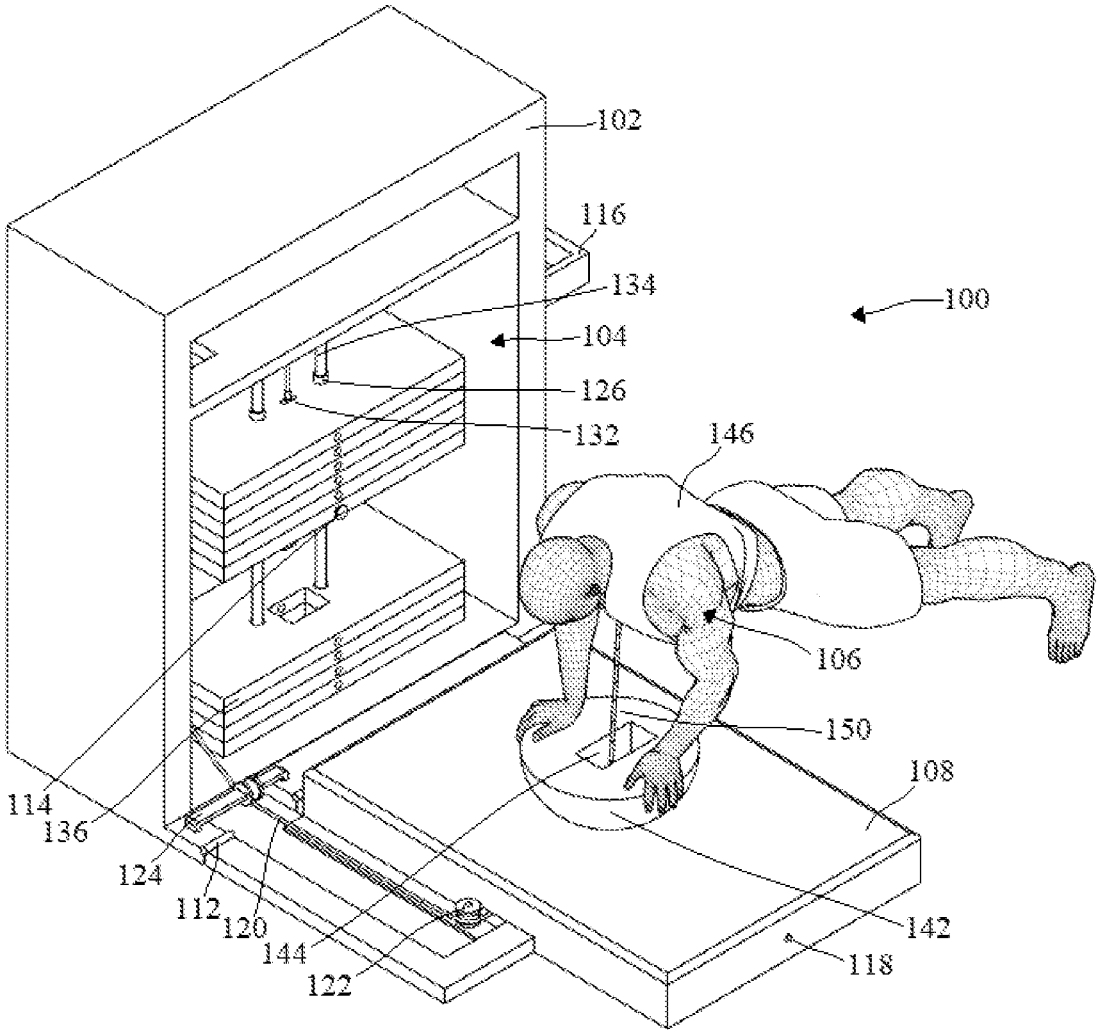
FIGS. 8A to 8C show a user assuming a push-up exercise position on balance and stabilization equipment on maximum push-up exercise machine in accordance with one embodiment.
Figure 8B:
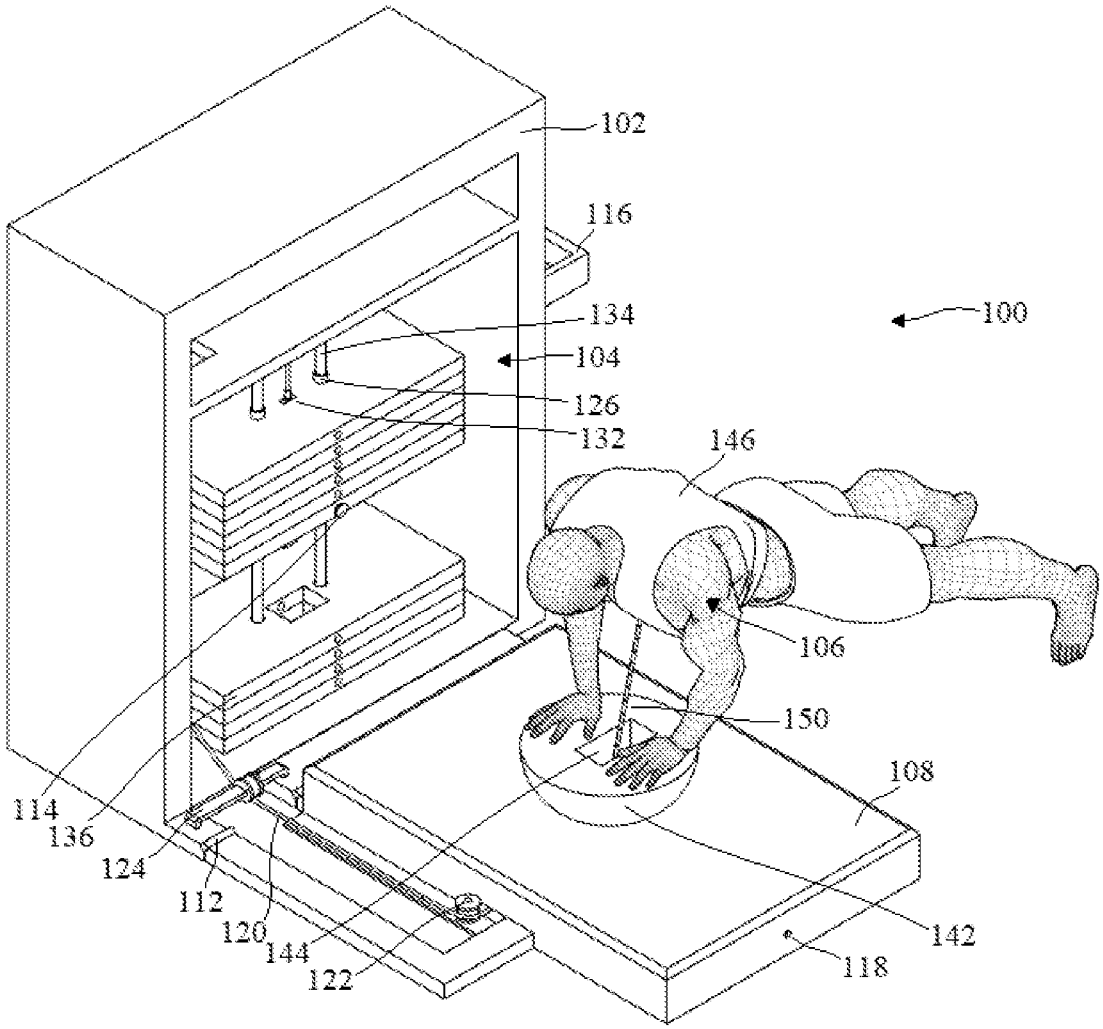
Figure 8C:
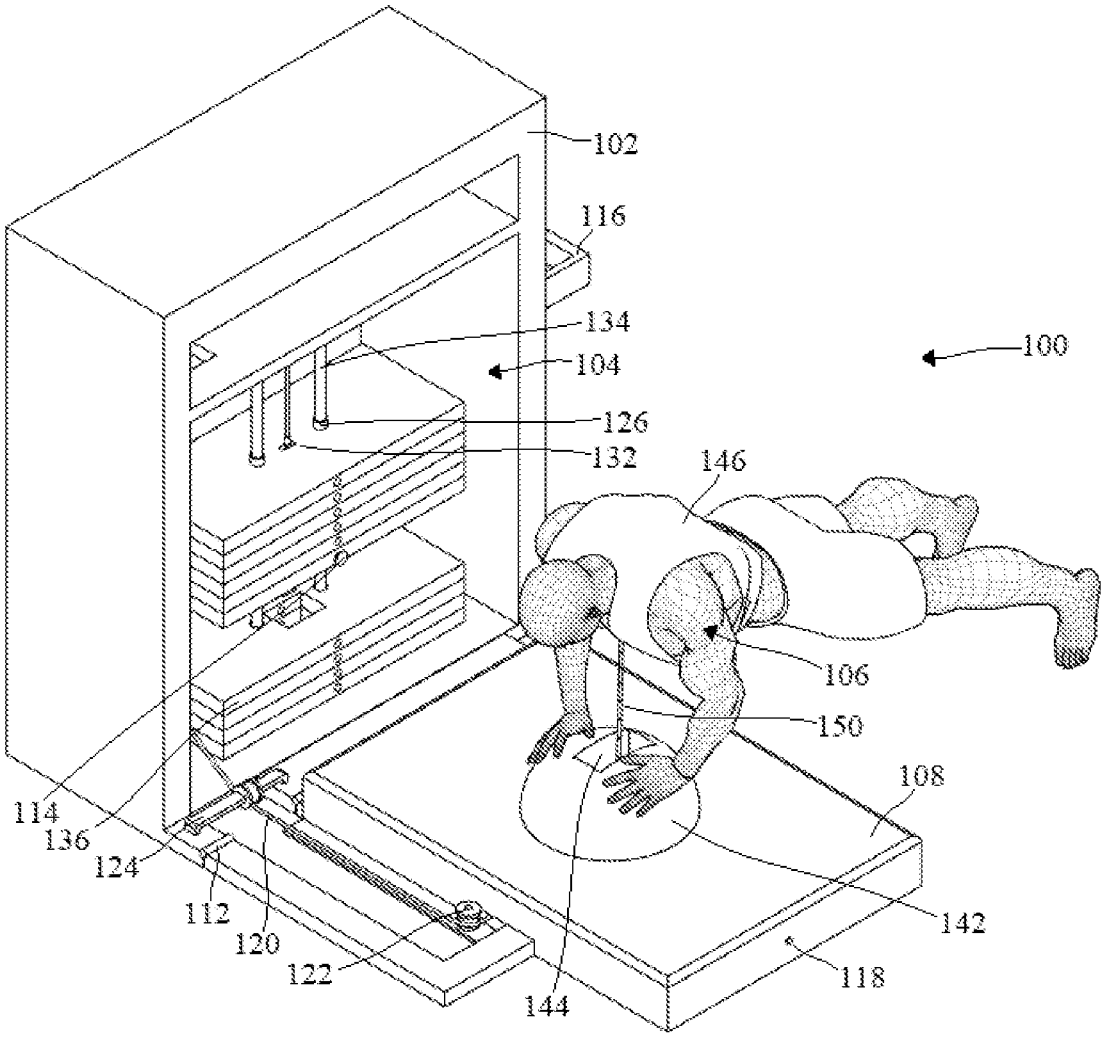

Another exercise a user 106 can perform is push-up exercise with hands on a balance and stabilization equipment 142 having a balance and stabilization equipment opening 144 with convex side on the platform 108 by wearing a harness or belt 146 with a chain 150 having snap link hook suspended from the harness or belt 146 configured to connect to a cable thimble 110 through the balance and stabilization equipment opening 144 to overcome the weight selected from the weight stack 136 of the cable-pulley weight stack system 104 as shown in FIGS. 8A and 8B. This emphasizes on core development and the user can increase the difficulty of the exercise by adding weight. When the flat side of the balance and stabilization equipment 142 having a balance and stabilization equipment opening 144 is on the platform 108 the user can perform push-up exercise with hands on half ball as shown in FIG. 8C. This emphasizes on inner chest and users can perform this exercise with additional weight to overcome from the weight stack 136 of the cable-pulley weight stack system 104. The balance and stabilization equipment may be made of a wooden material with comfort anti-slip grip surface on the flat side of it, high density expanded polypropylene (EPP) foam like foam rollers, or any material known in the art that will withstand a user's weight plus the weight of the weight stack.

DRAWINGS—REFERENCE NUMERALS

| | | | |
|---|---|---|---|
| 100 | maximum push-up exercise machine | 102 | cable-pulley weight stack system housing |
| 104 | cable-pulley weight stack system | 106 | user |
| 108 | platform | 110 | cable thimble |
| 112 | hinge | 114 | weight stack selector pin |
| 116 | container | 118 | rod |
| 120 | cable | 122 | pulley |
| 124 | pulley mounts | 126 | shaft collar |
| 128 | rubber weight stack cushions | 130 | weight stack center selector shaft |
| 132 | cable-to-weight stack adapter | 134 | weight stack guide rods |
| 136 | weight stack | 138 | push-up bars |
| 140 | push-up bar cable connector | 142 | balance and stabilization equipment |
| 144 | balance and stabilization equipment opening | 148 | single cable handle attachment |
| 146 | harness or belt | | |
| 150 | chain | | |

Advantages

From the description above, a number of advantages of my maximum push-up exercise machine become evident:

(a) The user can perform finger push-ups, knuckle (punch/fist) push-ups, planks, push-ups on balance and stabilization equipment, and push-up to row exercises with weights all in one machine.

(b) The user can progress in the above exercises consistently since it can all be done in one designated space without spending time to set up saving time and great for organization and avoidance of injury.

(c) The user can eliminate muscular effort from lifting weight plates and placing them in pegs to add or reduce weight with the use of a cable pulley weight stack system adding intensity to the above exercises.

(d) The user can train their core muscles and the muscles of their fingers, hands, and wrists heavily in one machine performing compound (multi-joint) exercises instead of isolation (single-joint) exercises.

CONCLUSION, RAMIFICATIONS, AND SCOPE

Accordingly, the reader will see that the maximum push-up exercise machine allows a user to perform various push-up exercises in the prone position such as finger push-ups, and knuckle push-ups through dynamic motion (full range motion and partial range of motion) and static position (yielding isometrics and overcoming isometrics) with weights in one machine. Also, the user can quickly change the weight and multiple users can perform push-ups with weights together with no muscular effort lost from lifting weight plates and placing them in pegs. In addition, the user can perform push-ups with weights using exercise equipment (i.e., push-up bars, single cable handle attachment, etc.) of their choosing. Furthermore, the maximum push-up exercise machine has the additional advantages in that:

it allows the user to perform push-up to row plank hold exercise which is a unique exercise that works the core muscles heavily while working other muscles as well as saving user's time to spend on isolation exercises to target core muscles.

it allows the user to train their core muscles and the muscles of their hands, fingers, and wrists more often and consistently along with other muscle groups without spending time performing isolation (single-joint) exercises, performing workouts for core and lower arm muscles, and effecting one's recovery because of time spent performing core and lower arm workouts from major workouts and/or sports.

it allows the user to perform numerous exercises in one machine that are beneficial to people of all ages.

it provides a user a complete workout when paired with pulling exercises, shoulder presses, and lower body exercises.

The above described embodiment is not intended to limit the scope of the present invention, as one skilled in the art can, in view of the present invention, expand such embodiment to correspond with the subject matter of the present invention claimed below. Therefore, all such substitutions and modifications are intended to be embraced within the scope of the invention as defined in the appended claims.

SEQUENCE LISTING

Not Applicable

We claim:

1. A balance and stabilization exercise device, comprising:

a main body having a partial ball shape defined by an outer surface having a partial spherical section and a flat circular section;

a through channel adapted to receive a cable therethrough, wherein the through channel extends through the partial spherical section and the flat circular section;

the through channel thereby allowing a user to perform resisted exercises with the balance and stabilization exercise device by engaging either the partial spherical section or the flat circular section while the cable passes through the through channel to operably engage a user at one end and a resistance object.

2. The balance and stabilization exercise device of claim 1, wherein the partial ball shape is a half ball shape.

3. The balance and stabilization exercise device of claim 1, wherein the through channel is a rigid through channel.

4. The balance and stabilization exercise device of claim 1, wherein the partial spherical section is comprised of a rigid material.

5. The balance and stabilization exercise device of claim 1, wherein the flat circular section is an anti-slip grip surface.

6. A balance and stabilization exercise device, comprising:

a main body having a partial ball shape defined by an outer surface having a partial spherical section and a flat circular section;

a rigid through channel adapted to receive a cable therethrough, wherein the rigid through channel extends through the partial spherical section and the flat circular section;

the rigid through channel thereby allowing a user to perform resisted exercises with the balance and stabilization exercise device by engaging either the partial spherical section or the flat circular section while the cable passes through the rigid through channel to operably engage a user.

7. The balance and stabilization exercise device of claim 6, wherein the partial ball shape is a half ball shape.

8. The balance and stabilization exercise device of claim 6, wherein the partial spherical section is comprised of a rigid material.

9. The balance and stabilization exercise device of claim 6, wherein the flat circular section is an anti-slip grip surface.

10. A method for performing balance and stabilization exercises, comprising:

providing a cable configured to add resistance to a user when operably connected to the user;

providing a balance and stabilization exercise device, the balance and stabilization exercise device including:

a main body having a partial ball shape defined by an outer surface having a partial spherical section and a flat circular section;

a rigid through channel adapted to receive a cable therethrough, wherein the rigid through channel extends through the partial spherical section and the flat circular section;

passing the cable through the rigid through channel in the balance and stabilization exercise device and operably connecting the cable to the user; and performing one or more exercises, by the user, while operably engaging the balance and stabilization exercise device.

11. The method of claim 10, wherein the cable is connected to a weight stack.

12. The method of claim 10, wherein the partial ball shape is a half ball shape.

13. The method of claim 10, wherein the partial spherical section is comprised of a rigid material.

14. The method of claim 10, wherein the flat circular section is an anti-slip grip surface.

15. The method of claim 10, further including attaching one end of the cable to a belt or harness worn by the user.

* * * * *